US005984311A

United States Patent [19]

Stefanik et al.

[11] Patent Number: 5,984,311

[45] Date of Patent: Nov. 16, 1999

[54] TRAVEL GAME AND METHOD OF PLAY

[76] Inventors: Frank John Stefanik, 10432 King Cole La., Strongsville, Ohio 44136-1400; Michael Stefanik, 7200 Ridge Rd., Parma, Ohio 44129

[21] Appl. No.: 09/036,630

[22] Filed: Mar. 7, 1998

[51] Int. Cl.[6] ..... A63B 9/00

[52] U.S. Cl. ..... 273/459

[58] Field of Search ..... 273/459, 430

[56] References Cited

U.S. PATENT DOCUMENTS

| | | | |
|---|---|---|---|
| 2,000,369 | 5/1935 | Zeiss | 273/459 |
| 5,056,798 | 10/1991 | Wherley | 273/460 |
| 5,145,183 | 9/1992 | Gates | 273/240 |
| 5,193,818 | 3/1993 | Leeson | 273/430 X |

OTHER PUBLICATIONS

Roadtrip Game Rules and Activity Pad Sample from Road Trip Game by ToySense Inc. No date known.

License Plate Games from Interstate Directory Publishing Company Dec. 1995.

*Primary Examiner*—William H. Grieb

[57] ABSTRACT

A license plate observation game is played by passengers traveling in an automobile by reading information on official bureaus of motor vehicle license plates, recording that information and scoring points directly from the recorded information or derivatives thereof. Points are scored by attributing values to the alphanumeric characters and pictures or images on the license plates and to the origin of the license plate. Each number on the license plate is worth its numerical value. Each alphabetic character on the license plate is attributed one point. Additional points may be gained by correlating specific alphanumeric combinations, abbreviations or variations to proper names and words from both the alphabetic and numeric characters. Players enhance their scores by making the most favorable alphanumeric correlations possibly discernable from the license plates.

19 Claims, 5 Drawing Sheets

23 Start Time _____ AM/PM
End Time _____ AM/PM

10

| Names of States | Points | Names of States | Points |
|---|---|---|---|
| Alabama | 7 | North Dakota | 11 |
| Alaska** | 6 | Ohio | 4 |
| Arizona | 7 | Oklahoma | 8 |
| Arkansas | 8 | Oregon | 6 |
| California | 10 | Pennsylvania | 12 |
| Colorado | 8 | Rhode Island | 11 |
| Connecticut | 10 | South Carolina | 13 |
| Delaware | 8 | South Dakota | 11 |
| Florida | 7 | Tennessee | 9 |
| Georgia | 7 | Texas | 5 |
| Hawaii** | 6 | Utah | 4 |
| Idaho | 5 | Vermont | 7 |
| Illinois | 8 | Virginia | 8 |
| Indiana | 7 | Washington | 10 |
| Iowa | 4 | Washington D.C. | 12 |
| Kansas | 6 | West Virginia | 12 |
| Kentucky | 8 | Wisconsin | 9 |
| Louisiana | 9 | Wyoming | 7 |
| Maine | 5 | Canadian Providences** | |
| Maryland | 8 | | |
| Massachusetts | 13 | Alberta | 7 |
| Michigan | 8 | British Columbia | 15 |
| Minnesota | 9 | Manitoba | 8 |
| Mississippi | 11 | New Brunswick | 12 |
| Missouri | 8 | Northwest Territories | 20 |
| Montana | 7 | Nova Scotia | 10 |
| Nebraska | 8 | Ontario | 7 |
| Nevada | 6 | Prince Edward Charles | 19 |
| New Hampshire | 12 | Quebec | 6 |
| New Jersey | 9 | Saskatchewan | 12 |
| New Mexico | 9 | Yukon Territories | 16 |
| New York | 7 | Other Countries** | |
| North Carolina | 13 | | |

Total "Names of Origin" Points ___51___

12

| License Plate # |
|---|
| 128 696 |
| BVW 289 |
| T 38896 |
| 428*616 |
| 567890 |
| VFW 6598 |
| T 79854 |
| 858_832 |
| ABC 999 |
| 065387 |
| Trailer Plate |
| BETTY 2 |
| Ohio Plate |
| Donette |
| Ohio L.E. Plate |
| FSU 1 |
| GONDHI |
| Indiana Plate |
| IAMBEV |
| JAVA |
| Indiana Plate |
| Ohio Plate |
| MBA 1999 |
| NANCY |
| 1 CPA |
| LBS 0347 |
| QUEEN |
| Wildlife Plate |
| Trailer Plate |
| T 79854 |
| UAW 0131 |
| VA FHA |
| Wash. St. Plate |
| XRX 318 |
| Penn. Plate |
| Z 203415 |

14

| Number Points (Total for each line) | |
|---|---|
| 128 696 | _32_ |
| 289 | _19_ |
| 38896 | _34_ |
| 428*616 | _27_ |
| 567890 | _35_ |
| 6598 | _28_ |
| 79854 | _33_ |
| 858_832 | _34_ |
| 999 | _27_ |
| 065387 | _29_ |
| Total Numerical Points | _298_ |
| **Alphabet Points (Total for each letter)** | |
| Apportioned | _11_ |
| Betty the Second (BETTY 2) | _14_ |
| Cuyahoga, Ohio | _12_ |
| Donette | _07_ |
| Erie Our Great Lake | _16_ |
| Florida State University (FSU) | _22_ |
| GONDHI | _06_ |
| Ham Radio | _08_ |
| IAMBEV (I am Beverly) | _10_ |
| JAVA | _04_ |
| Kids First | _09_ |
| Lighthouse (picture) | _10_ |
| Masters of Business Administration (MBA) | _10_ |
| NANCY | _05_ |
| One Certified Public Accountant (1 CPA) | _28_ |
| Pounds (LBS) | _05_ |
| QUEEN | _05_ |
| Red Cardinal | _11_ |
| Semi Trailer | _11_ |
| T (abbreviation for TANTALUM an element) | _08_ |
| United Auto Workers (UAW) | _17_ |
| Veterans Administration (VA) | _22_ |
| Washington | _10_ |
| Xerox | _05_ |
| You've Got a Friend in Pennsylvania | _29_ |
| Zenith Distance (abbr. in astronomy) | _14_ |
| Total Alphabet Points | _330_ |
| Total Game Points | _749_ |

16

18 20 22

23 Start Time _____ AM/PM
End Time _____ AM/PM

10

| Names of States | Points | Names of States | Points |
|---|---|---|---|
| Alabama | 7 | North Dakota | 11 |
| Alaska** | 6 | Ohio | 4 |
| Arizona | 7 | Oklahoma | 8 |
| Arkansas | 8 | Oregon | 6 |
| California | 10 | Pennsylvania | 12 |
| Colorado | 8 | Rhode Island | 11 |
| Connecticut | 10 | South Carolina | 13 |
| Delaware | 8 | South Dakota | 11 |
| Florida | 7 | Tennessee | 9 |
| Georgia | 7 | Texas | 5 |
| Hawaii** | 6 | Utah | 4 |
| Idaho | 5 | Vermont | 7 |
| Illinois | 8 | Virginia | 8 |
| Indiana | 7 | Washington | 10 |
| Iowa | 4 | Washington D.C. | 12 |
| Kansas | 6 | West Virginia | 12 |
| Kentucky | 8 | Wisconsin | 9 |
| Louisiana | 9 | Wyoming | 7 |
| Maine | 5 | Canadian Providences** | |
| Maryland | 8 | | |
| Massachusetts | 13 | Alberta | 7 |
| Michigan | 8 | British Columbia | 15 |
| Minnesota | 9 | Manitoba | 8 |
| Mississippi | 11 | New Brunswick | 12 |
| Missouri | 8 | Northwest Territories | 20 |
| Montana | 7 | Nova Scotia | 10 |
| Nebraska | 8 | Ontario | 7 |
| Nevada | 6 | Prince Edward Charles | 19 |
| New Hampshire | 12 | Quebec | 6 |
| New Jersey | 9 | Saskatchewan | 12 |
| New Mexico | 9 | Yukon Territories | 16 |
| New York | 7 | Other Countries** | |
| North Carolina | 13 | | |

Total "Names of Origin" Points ____

12

License Plate #

18

14

Number Points (Total for each line)

1 _____
2 _____
3 _____
4 _____
5 _____
6 _____
7 _____
8 _____
9 _____
0 _____

16

Total Numerical Points

Alphabet Points (Total for each letter)

A _____
B _____
C _____
D _____
E _____
F _____
G _____
H _____
I _____
J _____
K _____
L _____
M _____
N _____
O _____
P _____
Q _____
R _____
S _____
T _____
U _____
V _____
W _____
X _____
Y _____
Z _____

Total Alphabet Points

Total Game Points

20

22

FIG-1

23 { Start Time _____ AM/PM
End Time _____ AM/PM

10

| Names of States | Points | Names of States | Points |
|---|---|---|---|
| Alabama | 7 | North Dakota | 11 |
| Alaska** | 6 | Ohio | 4 |
| Arizona | 7 | Oklahoma | 8 |
| Arkansas | 8 | Oregon | 6 |
| California | 10 | Pennsylvania | 12 |
| Colorado | 8 | Rhode Island | 11 |
| Connecticut | 10 | South Carolina | 13 |
| Delaware | 8 | South Dakota | 11 |
| Florida | 7 | Tennessee | 9 |
| Georgia | 7 | Texas | 5 |
| Hawaii** | 6 | Utah | 4 |
| Idaho | 5 | Vermont | 7 |
| Illinois | 8 | Virginia | 8 |
| Indiana | 7 | Washington | 10 |
| Iowa | 4 | Washington D.C. | 12 |
| Kansas | 6 | West Virginia | 12 |
| Kentucky | 8 | Wisconsin | 9 |
| Louisiana | 9 | Wyoming | 7 |
| Maine | 5 | Canadian Providences** | |
| Maryland | 8 | | |
| Massachusetts | 13 | Alberta | 7 |
| Michigan | 8 | British Columbia | 15 |
| Minnesota | 9 | Manitoba | 8 |
| Mississippi | 11 | New Brunswick | 12 |
| Missouri | 8 | Northwest Territories | 20 |
| Montana | 7 | Nova Scotia | 10 |
| Nebraska | 8 | Ontario | 7 |
| Nevada | 6 | Prince Edward Charles | 19 |
| New Hampshire | 12 | Quebec | 6 |
| New Jersey | 9 | Saskatchewan | 12 |
| New Mexico | 9 | Yukon Territories | 16 |
| New York | 7 | Other Countries** | |
| North Carolina | 13 | | |

Total "Names of Origin" Points 51

12 — 14 — 16

| License Plate # | Number Points (Total for each line) | |
|---|---|---|
| 128 696 | 128 696 | _32_ |
| BVW 289 | 289 | _19_ |
| T 38896 | 38896 | _34_ |
| 428*616 | 428*616 | _27_ |
| 567890 | 567890 | _35_ |
| VFW 6598 | 6598 | _28_ |
| T 79854 | 79854 | _33_ |
| 858_832 | 858_832 | _34_ |
| ABC 999 | 999 | _27_ |
| 065387 | 065387 | _29_ |
| | Total Numerical Points | _298_ |
| | Alphabet Points (Total for each letter) | |
| Trailer Plate | Apportioned | _11_ |
| BETTY 2 | Betty the Second (BETTY 2) | _14_ |
| Ohio Plate | Cuyahoga, Ohio | _12_ |
| Donette | Donette | _07_ |
| Ohio L.E. Plate | Erie Our Great Lake | _16_ |
| FSU 1 | Florida State University (FSU) | _22_ |
| GONDHI | GONDHI | _06_ |
| Indiana Plate | Ham Radio | _08_ |
| IAMBEV | IAMBEV (I am Beverly) | _10_ |
| JAVA | JAVA | _04_ |
| Indiana Plate | Kids First | _09_ |
| Ohio Plate | Lighthouse (picture) | _10_ |
| MBA 1999 | Masters of Business Administration (MBA) | _10_ |
| NANCY | NANCY | _05_ |
| 1 CPA | One Certified Public Accountant (1 CPA) | _28_ |
| LBS 0347 | Pounds (LBS) | _05_ |
| QUEEN | QUEEN | _05_ |
| Wildlife Plate | Red Cardinal | _11_ |
| Trailer Plate | Semi Trailer | _11_ |
| T 79854 | T (abbreviation for TANTALUM an element) | _08_ |
| UAW 0131 | United Auto Workers (UAW) | _17_ |
| VA FHA | Veterans Administration (VA) | _22_ |
| Wash. St. Plate | Washington | _10_ |
| XRX 318 | Xerox | _05_ |
| Penn. Plate | You've Got a Friend in Pennsylvania | _29_ |
| Z 203415 | Zenith Distance (abbr. in astronomy) | _14_ |
| | Total Alphabet Points | _330_ |
| | Total Game Points | _749_ |

18 — 20 — 22

FIG-2

| | POINTS |
|---|---|
| ORIGIN:OHIO | 4 |
| BIRTHPLACE OF AVIATION | 20 |
| AMERICAN DENTAL ASSOCIATION | 26 |
| 9399 | 30 (9+3+9+9) |
| CUYAHOGA COUNTY | 14 |
| OHIO | 4 |

TRAVEL GAME AND METHOD OF PLAY

TECHNICAL FIELD

The present invention relates generally to games and more particularly, a license plate observation game to be played by passengers traveling in an automobile.

BACKGROUND OF THE INVENTION

Traveling in an automobile can be tiresome, tedious and boring to passengers, particularly if those passengers are children. Parents are often trying to find ways to entertain them without distracting the driver. Affordable games offering diversions are important in order to make trips interesting and fun. Problems with some travel games, however, are that they either require too much set up time, are too difficult to operate or are too expensive. Previous efforts to provide entertainment for automobile passengers have often times fell short of player expectations and objectives. Travel games which meet these expectations are therefore highly desirable.

DISCLOSURE OF THE INVENTION

An object of the present invention is to provide an affordable travel game that provides fun and education to passengers.

According to the present invention, a method of playing a word forming game comprises the steps of:

The present invention provides an educational, exciting and affordable game for traveling in a car.

These and other objects, features and advantages of the present invention will become more apparent in the light of the detailed description of exemplary embodiments thereof, as illustrated by the drawings.

BRIEF DESCRIPTION OF THE DRAWINGS

FIG. 1 is an exemplary score sheet in accordance with an embodiment of the present game.

FIG. 2 is an example of a completed score sheet in accordance with the present game.

BEST MODE FOR CARRYING OUT THE INVENTION

Figure 3:
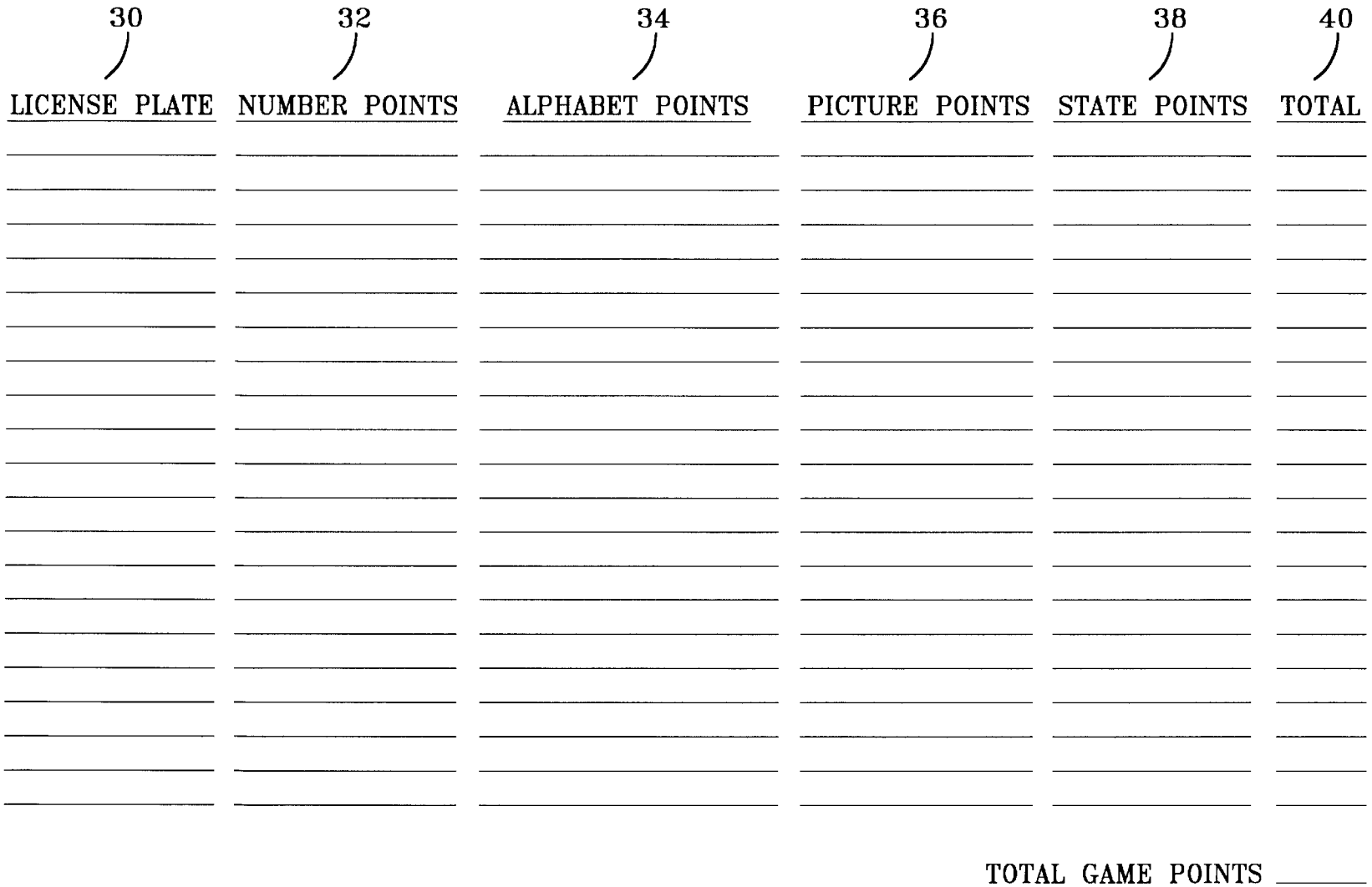
FIG. 3 is an exemplary score sheet in accordance with an alternative embodiment of the present game.

The game is played by reading information or data on official bureaus of motor vehicle license plates, recording that information and scoring points directly from the recorded information or derivatives thereof. Preferably, the information is only that information which is on the license plate itself. To this end, excluded would be writing on license plate holders, front and rear bumpers, mud flaps, trailer doors and hitches, trunk lids, etc. The information is then written down or recorded by the player observing the license plate. The same license plate could be used by more than one player for information. Alternatively, the game could be played such that once a license plate is recorded by a player, other players are forbidden from using information on that same plate.

After recording the license plate, points are scored by attributing values to the alphanumeric characters and pictures or images on the license plates and to the origin of the license plate. Each number on the license plate is worth its numerical value. Each alphabetic character on the license plate is attributed one point. Additional points, however, may be gained by correlating specific alphanumeric combinations, abbreviations or variations to proper names and words from both the alphabetic and numeric characters. Players therefore can enhance or maximize their scores by making the most favorable alphanumeric correlations possibly discernable from the license plates. Acceptable correlation categories include but are not limited to corporate names, academic institutions, social organizations, known phrases, and known abbreviations. Vanity plates are particularly useful for making favorable correlations.

Any pictures on the license plate can be spelled out in the most favorable way and recorded as alphabetical characters and scored as such.

Points on each license plate can therefore be accumulated on the score sheet according to: i) license plate origin; ii) numerical values; iii) pictures; and iv) formal, informal and phonetically spelled words, names, persons, places, things, abbreviations, expressions, phrases and the like. Examples of how the license plate information is recorded and scored will be shown and described hereinafter with exemplary references shown in the Figures.

In the first category i) above, points are awarded for the equivalent letter values for the names of origin of the license plate. The origin will be a State in the Union, a Providence of Canada, a foreign country, or a U.S. Territory. For example, a Virginia license plate would provide a total of eight points in this category. Section 10 of FIG. 1 provides an exemplary list of some of the origins which are acceptable for this category.

In the second category ii) above, points are awarded for numerical characters (or numbers) on the license plate by adding the integers together. For example, a license plate such as BHV 376 would provide a total of sixteen points for this category.

In the third category iii) above, points are awarded for spelling out any pictorial illustrations on the license plate, and then counting the number of alphabetic characters in the description of the picture. For example, a picture of a "bird" would yield four points. A more creative player would find it more valuable to specify the type of bird, such as a "bald eagle", which would yield nine points.

In the fourth category iv) above, points are awarded or attributed for the alphabetic characters on the license plate, and/or any formal, informal and phonetically spelled words, names, persons, places, things, abbreviations, expressions or phrases that the contestant can derive from those alphabetic characters. Numeric characters can be combined in this category also. For example, "BETTY 2" could be recorded as "BETTY TWO" (eight points) or "BETTY THE SECOND" (fourteen points). A numeric character used in this category cannot be simultaneously used in category ii) above.

Words, names and phrases that are intentionally misspelled for character limitization (or refused registration by the BMV for not being the first to register) shall be recorded and could be awarded as if they were spelled correctly. For example, a license plate with the name "WILYUM" should be recorded under the letter "W" and awarded as "WILLIAM" for seven points.

An "official" dictionary is preferably utilized to provide acceptable words and proper spelling for this third category. To this end, an official dictionary could be provided with the game. If no reference materials are available to settle disputes, a non-player such as the driver may act as an arbiter to make rulings on the claimed point values.

Table 1 below provides examples of enhancements using only one letter of the alphabet, and the number of points for those enhancements. The enhancements are abbreviations which use only one letter of the alphabet. These abbreviations can be found in widely accepted dictionary, such as Webster's. Single letter abbreviations are particularly useful when time is at a premium. The bold letters in Table 1 correspond to the line in section 20 of FIG. 1 where the entry would be made. Also provided in Table 1 are exemplary license plates that some of the entries could be derived from.

TABLE 1

| SAMPLE ONE LETTER ABBREVIATIONS | |
|---|---|
| | A = America (7 points) |
| | A = Argon (5 points) chemical |
| B438 113 | B = Bachelor (8 points) |
| | B = Bishop (6 points) chess |
| | B = Boron (5 points) chemical |
| | B = British (7 points) |
| C 210 ET | C = Carbon (6 points) chemical |
| | C = Catholic (8 points) |
| | C = Centimeter (10 points) |
| | C = Congress (8 points) |
| | C = Conservative (12 points) |
| D686JA | D = December (8 points) |
| | D = Democrat (8 points) |
| | D = Duchess (7 points) |
| E 45 E | E = East (4 points) Eastern (7 points) |
| | E = Engineer (8 points) Engineering (11 points) |
| | E = Entrance (8 points) theater |
| F50 683 | F = Fahrenheit (10 points) |
| | F = February (9 points) |
| | F = Fluorine (8 points) chemical |
| | F = Function (8 points) math |
| G257KZ | G = Conductance (11 points) electricity |
| | G = Gallium (7 points) chemical |
| | G = General Intelligence (19 points) |
| | G = German (6 points) |
| H 738 BV | H = Hardness (8 points) |
| | H = Husband (7 points) |
| I 031204 | I = Intransitive (12 points) |
| | I = Iodine (6 points) chemical |
| NV 643J | J = Joule (5 points) physics |
| | J = Justice (7 points) |
| NV 583 K | K = Capacity (8 points) electricity |
| | K = King (4 points) chess |
| | K = Potassium (9 points) chemical |
| L 903211 | L = Coefficient of Inductance (23 points) electricity |
| | L = Latitude (8 points) |
| | L = Longitude (9 points) |
| W 129 M | M = Manitoba (8 points) |
| | M = Monday (6 points) |
| | M = Thousand (8 points) |
| N587KY | N = Nationalist (11 points) |
| | N = Nitrogen (8 points) |
| | N = North (5 points) Northern (8 points) |
| | N = November (8 points) |
| O 343 JA | O = October (7 points) |
| | O = Ontario (7 points) |
| | O = Oxygen (6 points) |
| P586WT | P = Parental (8 points) |
| | P = Participle (10 points) |
| | P = Perishable (10 points) |
| P763FL | P = Phosphorus (10 points) |
| | P = Population (10 points) |
| P956556 | P = Prompter (8 points) |
| Q 27904 | Q = Quarter (6 points) Quarterly (8 points) |
| | Q = Quebec (6 points) |
| | Q = Quintal (6 points) |
| R 272 JC | R = Radical (7 points) |
| | R = Republican (10 points) |
| | R = Resistance (10 points) |
| | R = Response (8 points) church service |

TABLE 1-continued

| SAMPLE ONE LETTER ABBREVIATIONS | |
|---|---|
| A 200 S | S = Sabbath (7 points) |
| | S = Saturday (8 points) |
| | S = September (9 points) |
| | S = Socialist (9 points) |
| | S = Substantive (11 points) |
| T33 7TB | T = Tantalum (8 points) chemical |
| | T = Telephone (9 points) |
| | T = Temperature (11 points) |
| | T = Testament (9 points) |
| | T = Transitive (10 points) |
| | T = Tuesday (7 points) |
| | U = University (10 points) |
| | U = Uranium (7 points) chemical |
| | V = Vanadium (8 points) chemical |
| | V = Venerable (9 points) |
| | V = Vocative (8 points) |
| | V = Volunteers (10 points) |
| | W = Warehousing (11 points) |
| | W = Washington (10 points) |
| | W = Wednesday (9 points) |
| | X = An unknown quantity (17 points) mathematics |
| | X = Christian (9 points) |
| | Y = An unknown quantity (17 points) mathematics |
| | Y = Young Men's Christian Association (29 points) |
| | Y = Yttrium (7 points) chemical |
| A 29 Z | Z = An unknown quantity (17 points) mathematics |
| | Z = Atomic Number (12 points) chemistry |
| | Z = Zenith Distance (14 points) astronomy |

Table 2 below provides examples of abbreviations for states of the Union, and the number of points for the enhancement of those abbreviations. Also provided in Table 2 are exemplary license plates that some of the entries could be derived from.

TABLE 2

| SAMPLE TWO LETTER ABBREVIATIONS | |
|---|---|
| | AK = Alaska (6 points) |
| | AL = Alabama (7 points) |
| | AR = Arkansas (8 points) |
| | AZ = Arizona (7 points) |
| | CA = California (10 points) |
| | CO = Colorado (8 points) |
| | CT = Connecticut (10 points) |
| | DE = Delaware (8 points) |
| | FL = Florida (7 points) |
| | GA = Georgia (7 points) |
| | HI = Hawaii (6 points) |
| | IA = Iowa (4 points) |
| | ID = Idaho (5 points) |
| | IL = Illinois (8 points) |
| | IN = Indiana (7 points) |
| | KS = Kansas (6 points) |
| N587KY | KY = Kentucky (8 points) |
| | LA = Louisiana (9 points) |
| | MA = Massachusetts (13 points) |
| | ME = Maine (5 points) |
| | MI = Michigan (8 points) |
| | MN = Minnesota (9 points) |
| | MO = Missouri (8 points) |
| | MS = Mississippi (11 points) |
| | MT = Montana (7 points) |
| | NC = North Carolina (13 points) |
| | ND = North Dakota (11 points) |
| | NE = Nebraska (8 points) |
| | NH = New Hampshire (12 points) |
| | NJ = New Jersey (9 points) |
| | NM = New Mexico (9 points) |
| | NV = Nevada (6 points) |
| E578NY | NY = New York (7 points) |
| | OH = Ohio (4 points) |
| | OK = Oklahoma (8 points) |

TABLE 2-continued

| SAMPLE TWO LETTER ABBREVIATIONS | |
|---|---|
| | OR = Oregon (6 points) |
| PA 5054 | PA = Pennsylvania (12 points) |
| | RI = Rhode Island (11 points) |
| | SC = South Carolina (13 points) |
| | SD = South Dakota (11 points) |
| | TN = Tennessee (8 points) |
| | TX = Texas (5 points) |
| | UT = Utah (4 points) |
| | WA = Washington (10 points) |
| | WI = Wisconsin (9 points) |
| | WY = Wyoming (7 points) |
| | WV = West Virginia (12 points) |
| | VA = Virginia (8 points) |
| VT 888 V | VT = Vermont (7 points) |

Table 3 below provides examples of typical phrases found on license plates that relate to districts, states and providences, and the number of points for those phrases. The majority of these advertisements are located at the bottom of the license plates, although some may be found at the top. The first letters in TABLE 3 correspond to the line in section 20 of FIG. 1 where the entry would be made.

TABLE 3

| PHRASES IMPORTANT TO DISTRICTS, STATES, AND PROVIDENCES |
|---|
| A Capital City (12 points) Washington D.C. |
| Amber Waves of Grain (17 points) Indiana |
| America's Dairyland (17 points) Wisconsin |
| Birthplace of Aviation (20 points) Ohio |
| Constitution State (16 points) Connecticut |
| Discover the Spirit (17 points) North Dakota |
| Erie our Great Lake (16 points) Ohio |
| First in Flight (13 points) North Carolina |
| Garden State (11 points) New Jersey |
| Grand Canyon State (16 points) Arizona |
| Great Lakes Splendor (18 points) Michigan |
| Greatest Snow On Earth (19 points) Utah |
| I am Sovereign (12 points) Quebec |
| Je Me Souviens (12 points) Quebec "I am Sovereign" |
| Keystone State (13 points) Pennsylvania |
| Kids First (9 points) Indiana |
| Land of Lincoln (13 points) Illinois |
| Oklahoma is O.K. (12 points) Oklahoma |
| Save the Manitee (14 points) Florida |
| Show Me State (11 points) Missouri |
| Ten Thousand Lakes (16 points) Minnesota |
| The First State (13 Points) Maryland |
| The Heart of it All (15 Points) Ohio |
| The Lone Star State (16 points) Texas |
| The Silver State (14 points) Nevada |
| The Spirit of America (18 points) Massachusetts |
| Wild, Wonderful West Virginia (25 points) |
| Yours to Discover (15 points) Ontario |
| You've Got a Friend in Pennsylvania (29 points) Penn. |

Table 4 below provides examples of enhancements of acronyms, abbreviations or misspellings of persons, places or things that may be found on license plates, and the number of points for those enhancements. A tip for players for these types of enhancements is to remember to "think outside the box". The first letters in Table 4 correspond to the line in section 20 of FIG. 1 where the entry would be made. Also provided in Table 4 are exemplary license plates that some of the entries could be derived from.

TABLE 4

| ACRONYMS | |
|---|---|
| AA 4349 | AA = Alcoholics Anonymous (19 points) |
| 423 AAA | AAA = American Automobile Association (29 points) |
| AARP 91 | AARP = American Association of Retired Persons (35 Points) |
| AAU 1550 | AAU = Amateur Athletic Union (20 points) |
| ABA 6874 | ABA = American Bar Association (22 points) |
| ABA 6874 | ABA = American Basketball Association (29 points) |
| ABC 3179 | ABC = Reading, Writing and Arithmetic (27 points) |
| AC 8012 | AC = Air Conditioning (15 points) |
| AM 7103 | AM = Ante Meridian (12 points) |
| AMA 0144 | AMA = American Medical Association (26 points) |
| AMC 9536 | AMC = American Motors Corporation (25 points) |
| AP 5724 | AP = Associated Press (15 points) |
| BBA 34 | BBA = Bachelor of Business Administration |
| DC 565 R | DC = District of Columbia (18 points) |
| DQ 15 UV | DQ = Dairy Queen (10 points) |
| N 210 ET | ET = Extra terrestrial (15 points) |
| VA FHA | FHA = Federal Housing Authority (23 points) |
| | FYI = For Your Information (18 points) |
| 220 HP | HP = Horsepower (10 points) |
| | IBM = International Business Machine (28 points) |
| JCU 39 | JCU = John Carroll University (21 points) |
| | JD = Juris Doctorate (14 points) |
| 123 LBS | LBS = Pounds (6 points) |
| | MAX = Maximum (7 points) |
| | MIA = Missing in Action (15 points) |
| | MSU = Michigan State University (23 points) |
| | NEC = Nippon Electric Corporation (25 points) |
| OSU 69 | OSU = Ohio State University (19 points) |
| PAC 3214 | PAC = Political Action Committee (24 points) |
| PAL 1034 | PAL = Police Athletic League (20 points) |
| | PM = Post Meridian (12 points) |
| | PS = Post Script (10 points) |
| | QB = Quarterback (11 points) |
| | RN = Registered Nurse (15 points) |
| NA 4 RV | RV = Recreation Vehicle (17 points) |
| | SD = Standard Deviation (17 points) |
| PL 15 UK | UK = United Kingdom (13 points) |
| | VP = Vice President (13 points) |
| NU 92 VW | VW = Volkswagen (10 points) |
| WBF 2160 | WBF = World Boxing Federation (21 points) |
| WWW 927 | WWW = World Wide Web (12 points) |
| XXL 038 | XXL = Extra Extra Large (15 points) |
| GENERAL EXPRESSIONS AND PHRASES | |
| ASK AL | ASK AL (5 points) |
| ASK AL | ASK AL = Ask Allen (8 points) |
| A TAN4U | A TAN4U = A Tan For You (10 points) |
| BEATPITT | BEATPITT = Beat Pittsburgh (14 points) |
| BLDR 4U2 | BLDR 4U2 = Builder for You too (16 points) |
| BUY AHAT | BUY AHAT = Buy a Hat (7 points) |
| B4UC1 | B4UC1 = Be For You See One (14 points) |
| CRUISN 2 | CRUISN 2 = Cruising Too (11 points) |
| GOEDDE | GOEDDE = Go Eddie (7 points) |
| GO LIMO | GO LIMO = Go Limosine (10 points) |
| HAHAMAN | HAHA Man (7 points) comedian? |
| HANES 1 | HANES 1 = Hanes One (8 points) |
| HI UALL | HI UALL = Hi You All (8 points) |
| HOT2GO | HOT2GO = Hot to go (7 points) |
| IAMBEV | IAMBEV = I am Bev (6 points) |
| IAMBEV | IAMBEV = I am Beverly (10 points) |
| ILIKE IT | I LIKE IT (7 points) |
| IM 4 MU | IM4MU = I am for Michigan University (24 points) |
| INSURE 7 | INSURE 7 = Insure Seven (11 points) |
| LASR 1 | LASR 1 = Laser One (8 points) |
| LIV4LOV | LIV4LOV = Live for Love (11 points) tennis player? |
| ME NU2 | ME NU2 = Me and You Two (11 points) |
| MYGIRL3 | MY GIRL 3 = My Girl Three (11 points) |
| NETWK | NETWK = Network (7 points) |
| NETWK | NETWK = Networking (10 points) |
| NO TAX4U | NO TAX4U = No Tax for You (11 points) tax accountant? |
| NUDGE 1 | NUDGE 1 = Nudge One (8 points) |
| OH SHEA | OH SHEA (6 points) |
| PEACH E | PEACH E (5 points) |
| REBEL X | REBEL X = Rebel Ten (8 points) |
| STITCH 1 | STITCH 1 = Stitch One (9 points) |

TABLE 4-continued

| ACRONYMS | |
|---|---|
| STK2 S | TK 2 = Stock Two (8 points) |
| SUNSET1 | SUNSET1 = Sunset One (9 points) |
| SWNG ST | SWNG ST = Swing Street (11 points) jazz musician? |
| TABOO | TABOO (5 points) |
| THRMO 1 | THRMO 1 - Thermo One (9 points) |
| T SHWRS | T SHWRS = Thundershowers (14 points) |
| TRUSTS 1 | TRUSTS 1 = Trusts One (9 points) trust attorney? |
| WHYBREW | WHYBREW = Why Brew (8 points) coffee lover? |
| XHP 60K | XHP 60K = Extra Horse Power (15 points) |
| 1 TRY | 1 TRY = One Try (6 points) |
| 2 SHAY | 2 SHAY = Touche' (6 points) |
| 3 PUTTS | 3 PUTTS = Three Putts (10 points) |
| 4 UCATS | 4UCATS = For You Cats (10 points) U of Cincinnati Wildcats |
| 4THUNDER | 4THUNDER = For Thunder (10 points) |
| XHP 60K | 60K = Sixty Thousand (13 points) |
| NAMES OF PERSONS (FORMAL AND INFORMAL), PLACES, AND THINGS | |
| Btm of Plate | AMATEUR RADIO (12 points) Ohio |
| AM CARS | AM CARS = American Cars (12 points) |
| APLSEED | APLSEED = Appleseed (9 points) |
| BIG MET | BIG MET (6 points) |
| BLZR 4X4 | BLZR 4X4 = Blazer Four by Four (16 points) |
| CINC KID | CINC KID = Cincinnati Kid (13 points) |
| Btm of Plate | COLLECTOR'S VEHICLE (17 points) |
| COOL GMA | COOL GMA = Cool Grandma (11 points) |
| COOL GMA | COOL GMA = Cool Grandmother (15 points) |
| Btm of Plate | Culver City, Nevada (16 points) |
| Btm of Plate | Cuyahoga County, Ohio (18 points) |
| DARIN 3 | DARIN 3 = Darin Three (10 points) |
| DARIN 3 | DARIN 3 = Darin the Third (13 points) |
| Btm of Plate | DEALER (6 points) |
| ELVIS P | ELVIS P = Elvis Presley (12 points) |
| Btm of Plate | Environment (11 points) Indiana |
| FL CLWTR | FL CLWTR = Clearwater, Florida (17 points) |
| FL KEYS | FL KEYS = Florida Keys (11 points) |
| Btm of Plate | FORMER POW = Former Prisoner of War (19 points) |
| GLU DUDE | GLU DUDE = Glue Dude (8 points) defenseman? |
| GOLD MDL | GOLD MDL = Gold Medal (9 points) |
| GONDHI | GONDHI (6 points) |
| Btm of Plate | Great Lakes (10 points) |
| Btm of Plate | Historical Motorcycle (20 points) Ohio |
| Btm of Plate | Historical Vehicle (17 points) Ohio |
| Btm of Plate | Huron, Ohio (9 points) |
| ISA UMP | ISA UMP = I'm an Umpire (10 points) correct English |
| JELICLE | JELICLE (7 points) |
| JET SKI | JET SKI (6 points) |
| APLSEED | Johny Appleseed (14 points) |
| L DUCK | L DUCK = Lame Duck (8 points) |
| LBJ 038 | LBJ = Lyndon Baines Johnson (19 points) |
| LITL LU | LITL LU = Little Lou (9 points) |
| Btm of Plate | LIVERY VEH. = Livery Vehicle (13 points) |
| Btm of Plate | MANUFACTURER (12 points) |
| Btm of Plate | MANUFACTURER = Manufacturer's plate (18 points) |
| MRS DDS | MRS DDS = Misses Doctor of Dental Science (27 points) |
| PAL 1034 | PAL = Pal (3 points) |
| PATN OZ | PATN OZ = Patsy and Ozzie (13 points) |
| Btm of Plate | PERMANENT (8 points) |
| Side of Pit | PERSIAN GULF VETERAN (18 points) |
| PROPAGE | Pro Pager (8 points) |
| QUAZE | QUAZE (5 points) |
| RONS GT | RONS GT (6 points) |
| RONS GT | RONS GT = Ron's Gran Tourisimo (17 points) |
| STACI | STACI (5 points) |
| STACI | STACI = Stacey (6 points) |
| TEEBONE | TEE BONE (7 points) |
| THEO 1 | THEO 1 = Theo One (7 points) |
| THEO 1 | THEO 1 = Theo the First (12 points) |
| TONELOC | TONELOC (7 points) |
| TONY JR | TONY JR = Tony Junior (10 points) |
| TONY JR | TONY JR = Anthony Junior (13 points) |
| Btm of Plate | Tuscarawas County, Ohio (20 points) |
| TUTTLE | TUTTLE (6 points) vehicle owner's last name |
| ULAN 3 | ULAN 3 = Ulan Three (9 points) |
| ULAN 3 | ULAN 3 = Ulan The Third (12 points) |

TABLE 4-continued

| ACRONYMS | |
|---|---|
| Btm of Plate | US Armed Forces Retired (20 points) Ohio |
| Btm of Plate | US Armed Forces Services (21 points) Ohio |
| Side of Pit | VIETNAM = (7 points) |
| Side of Pit | VIETNAM VETERAN (14 points) |
| WHIZRD | WHIZRD = Whizard (7 points) |
| Btm of Plate | Wildlife = (8 points) Ohio |
| Side of Pit | WORLD WAR II VETERAN (17 points) Ohio |
| WOLVREEN | WOLVREEN = Wolverine (9 points) |
| ZEIGER | ZEIGER (6 points) vehicle owner's last name |
| 1 CPA | 1 CPA = One Certified Public Accountant (28 points) |
| 1 PHILLY | 1 PHILLY = One Philly (9 points) |
| 1 REDMEN | 1 REDMEN = One Redmen (9 points) |
| 1 USNA | 1 USNA = One United States Naval Academy (27 points) |
| 2 DUKIES | 2DUKIES = Two Dukies (9 points) |
| 4 BEATLZ | 4BEATLZ = Four Beatles (11 points) |
| 4 BEATLZ | 4BEATLZ = The Four Beatles (14 points) |
| 4 GOT | 4 Got = Forgot (6 points) |
| PHRASES WHICH ARE DIFFICULT TO DECIPHER | |
| HM SLLR | HM SLLR = Home Seller (10 points) |
| PGA WNAB | PGA WNAB = Professional Golfer Association Wanna Be (36 points) |
| TH DEVL | TH DEVL = The Devil (8 points) |
| W DISNY | W DISNY = Walt Disney (10 points) |
| WE TM UP | WE TM UP = We Tee Them Up (11 points) |
| YBSMALL | YBSMALL = Why Be Small (10 points) weightlifter? |
| 9S ENUF | 9S ENUF = Nine is Enough (12 points) |

Table 5 below provides examples of typical pictures or illustrations found on license plates, and the number of points for spelling out the description of those illustrations. The first letters in TABLE 5 correspond to the line in section 20 of FIG. 1 where the entry would be made.

TABLE 5

| PICTURES IMPORTANT TO STATES AND PROVIDENCES |
|---|
| BALD HEADED EAGLE (15 points) Indiana Environmental Plate |
| BLUE HERON (9 points) Ohio Scenic Rivers |
| BUFFALO (7 points) North Dakota |
| CARDINAL (8 points) Illinois & Ohio |
| FOOTBALL HALL of FAME (18 points) Ohio |
| GREAT BLUE HERON (14 points) Ohio Scenic Rivers |
| GEORGIA PEACH (12 points) Georgia |
| LIBERTY BELL (11 points) Pennsylvania |
| LIGHTHOUSE (10 points) Ohio Lake Erie Plate |
| MOUNTAIN RANGE (13 points) Washington |
| MANITEE (7 points) Florida Environmental Plate |
| PEACH (5 points) Georgia |
| RED CARDINAL (11 points) Illinois & Ohio |
| SOLDIER = United States National Guard (25 points) Ohio |
| SOLDIER = 7 points Ohio |
| STATUE of LIBERTY (15 points) New York |
| WHEELCHAIR = 10 points |
| WHEELCHAIR = Handicapped Driver (17 points) |

Table 6 bellows provides exemplary license plates, the value of the numerical characters observed on those plates, and where they should be entered on the score sheet. A tip for players is that temporary license plate tags and tractor trailer license plates are the best source of long numerical sequences. Also, tractors and trailers have different license plates. It is to be noted that a "0" is equal to zero points.

TABLE 6

| NUMERICAL VALUES | |
|---|---|
| 199 878 | 199 878 = 42 points with intervening space (Illinois) |
| AAP 289 | 289 = 19 points |
| 3 9991 3 | 9991 = 31 points (Ohio Dealer License Plate) |
| 428*616 | 428*616 = 27 points (Indiana) |
| AMC 5999 | 5999 = 32 points |
| AOV 6974 | 6974 = 26 points |
| T 771787 | 771787 = 37 points |
| 88 5836 | 88 5836 = 38 points (Ohio Dealer license plate) |
| AAU 999 | 999 = 27 points |
| JP 061254 | 061254 = 18 points |

Referring now to FIG. 1, the present invention includes a scorecard for writing down data or information derived from or located on official bureau of motor vehicle license plates observed by the participants of the game and then for scoring the recorded data according to the point system described above. The participants are preferably passengers in a moving automobile.

A section 10 of the scorecard of FIG. 1 is provided for recording information in category i) described hereinbefore, which in the present example is either the State in the Union, Canadian providence, or other foreign country. Upon observation, the appropriate state or providence is circled. Alternatively, other foreign countries are written in the space provided. Points are only counted once for any particular state or providence.

A section 12 is provided for entering license plate data exactly as it appears on license plates, with each line in section 12 being dedicated to one license plate. Each entry in section 12 is filled out whenever a contestant intends to use a particular license plate for information in category ii) described above, which is the numeric characters. A section 14 is provided for recording the respective numbers used in the section 12. It can be seen that there are ten lines in section 14, one line corresponding for number sequences beginning with each number of the decimal numbering system (i.e., 0–9). A section 16 is provided for adding the total value of the respective numbers recorded in section 14. Numerical points are recorded according to the first value occurring on the left of the sequence in section 12. A sequence of numbers ends, for scoring purposes, when it is interrupted by a letter. A sequence of numbers broken by an asterisk, crest, picture, or space but not an alphabetic character, should be recorded as if they were consecutive. No points are awarded for zeros.

A section 18 is provided for entering license plate data, with each line in section 18 being dedicated to one license plate. Each entry in section 18 is filled out whenever a contestant intends to use a particular license plate for information in categories iii) and iv) described above, which are the pictures and alphabetic characters.

A section 20 is provided for recording the respective alphabetic characters or corresponding words or alphabetic point enhancements for the alphabetic characters used in the section 18. It can be seen that there are twenty-six lines in section 18, one line corresponding for alphabetic sequences beginning with each letter in the alphabet. Alphabetic points are recorded in section 20 by the first letter of the word, the name of a person, place or thing, phrase, or abbreviation which has been identified.

It is to be noted that alphabetical and numerical abbreviations that represent a word beginning with a letter different than the first letter or number of the abbreviation should be recorded on the appropriate line in sections 18 and 20 for the first letter of the represented word. For example, "K" is an abbreviation for the word "Potassium" (worth ten points). These entries should therefore be recorded for the line starting with "P" in section 20 and the adjacent line in section 18. Another example is "3 PUTTS" could be written out correctly on the line in section 20 beginning with "T" for "THREE PUTTS" (worth ten points).

A section 22 is provided for adding the total values for the information in each respective line in section 20.

Entries made in any of sections 12, 14, 18 and 20 may be replaced by new entries (before the end of the game) if the contestant later finds a more valuable point entry. For example, a license plate entry of BA 6985 in section 12 (worth 28 points in section 14) could be replaced with a license plate CG 64857 (worth 30 points).

The object of the game is for each player to fill in as many fields or sections as possible while simultaneously scoring the highest number of points before the game ends. The game is over and the winner is determined either: a) upon arrival at the travel destination; b) once a predetermined time limit has expired; or c) when the first player completely fills in all of the line entries in sections 12, 14, 18 and 20 of his or her scorecard and declares that he or she is finished completing the scorecard. In those cases where no player's gameboard is complete, then the player with the highest number of accumulated points is declared the winner. In the event of a total point tie, the player with the most lines filled out is the winner. It is to be noted that it preferable that it not be required that Section 10 be completely filled out for completion of the game, since on relatively short trips it is unlikely that it would be possible to do so.

Referring now to FIG. 2, an exemplary completed score sheet is provided. In this example, every line in sections 12, 14, 18, and 20 is filled out. As the lines in section 14 descend down the page, the first digit of each line follows in consecutive order from 1 through 9 and 0. As the lines in section 20 descend down the page, the first digit of each line follows in consecutive order the letters of the alphabet from "A" through "Z". It is to be noted that a license plate bearing a picture of a red cardinal is recorded as such on the line for "R".

Referring now to FIG. 3, an alternative embodiment for the game of the present invention includes a scorecard for writing down data or information derived from or located on observed license plates and then for scoring the recorded data according to the point system described above. The scorecard has a first column 30 for entering the license plate data exactly as it appears on the license plate. A second column 32 is provided for entering the state or providence (if the license plate is from Canada). A third column 34 provides for entering the alphabetic characters or corresponding alphabetic point enhancement techniques (category iv) above). A fourth column 36 is provided for entering the numerical values utilized for the numerical character category ii) above. A fifth column 38 is provided for entering any a description of any pictures appearing on the license plate (category iii) above). A sixth column 40 is provided for entering the total added (or calculated) value for the three categories. The game is over and the winner is determined either: a) upon arrival at the travel destination; b) once a predetermined time limit has expired; or c) when the first player completely fills in all of the line entries of the scorecard.

Figure 4:
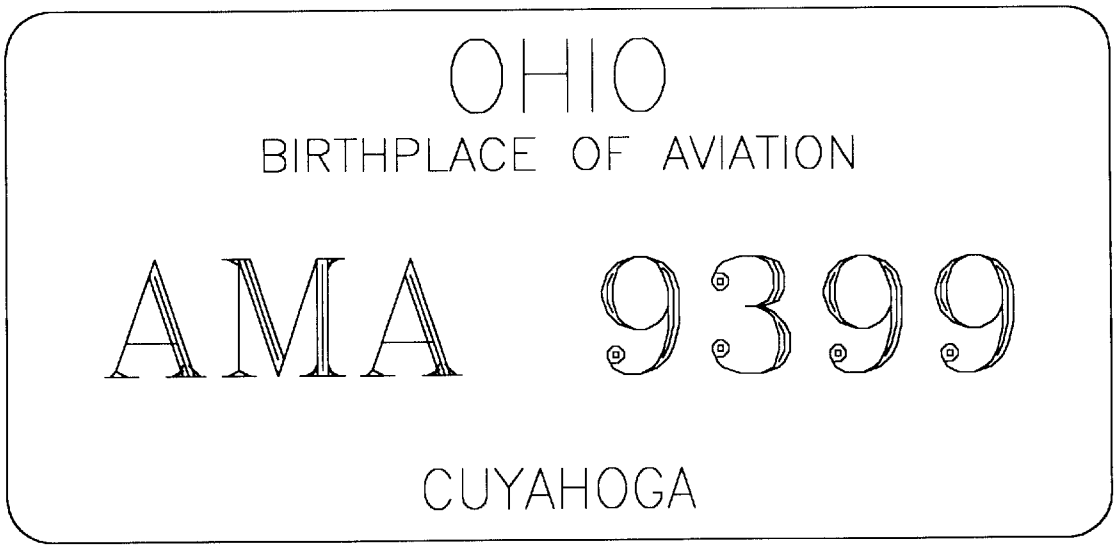
FIG. 4 is an illustration of an exemplary license plate for observation in accordance with the present game.
Figure 5:
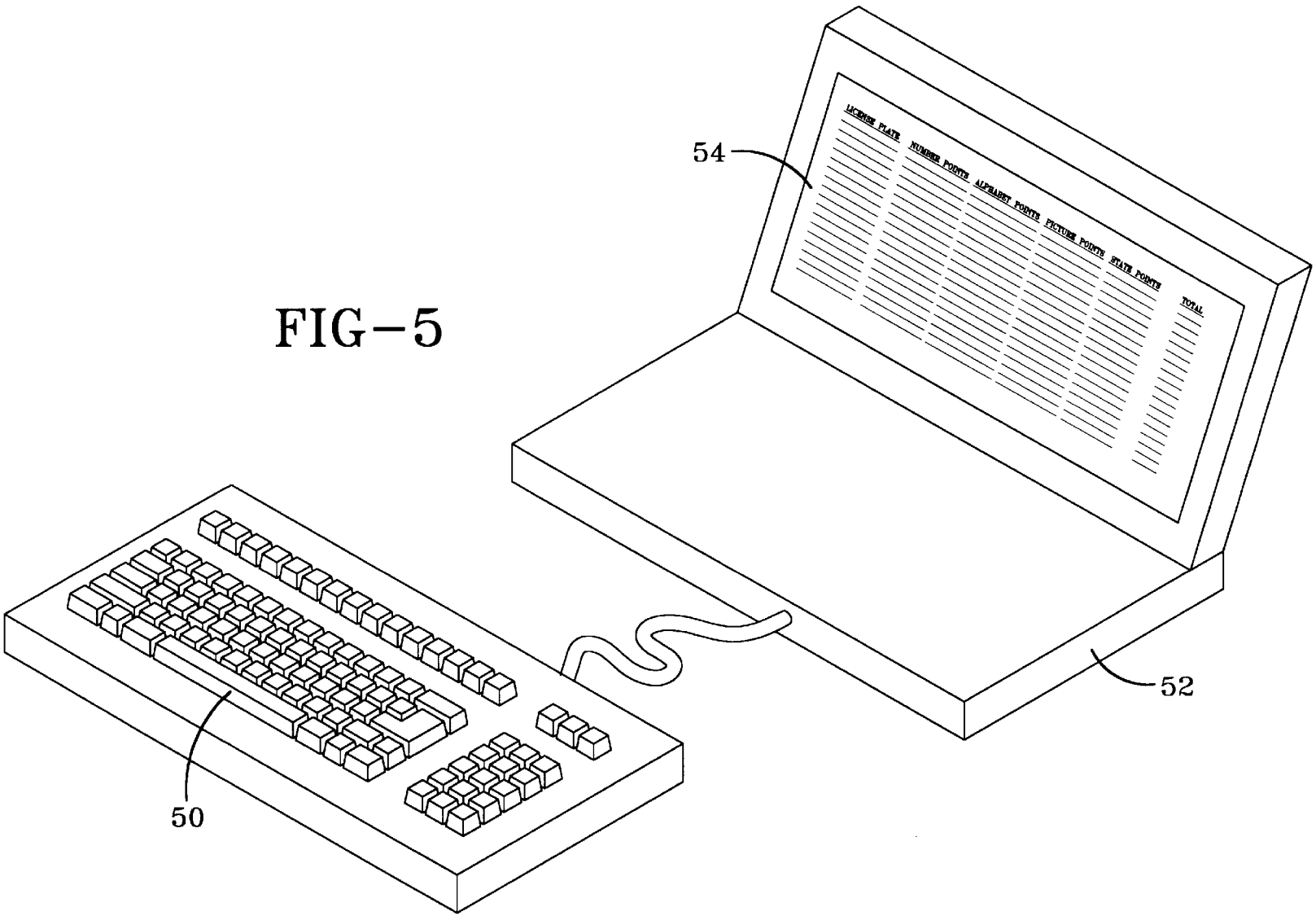
FIG. 5 is a schematic drawing of an electronic embodiment in accordance with present game.

Referring now to FIG. 4, the present invention may be comprised of a notepad having a plurality of score sheets such as those described above for entry of information thereon utilizing a writing instrument, such as a pen or pencil. Alternatively, the game may be comprised of an electronic apparatus having a keyboard 50, a display 52, and a controller 54 for reading the data from the keyboard and displaying data on the display. The controller would have a processor and memory. Electronic apparatus suitable for this purpose are well known to those skilled in the art. The electronic game could have provided in memory a dictionary for checking the correct spelling of the alphabetic enhancements described hereinbefore. It could also have a calculator to add up scores for the players. The controller could be equipped with voice recognition so that the player would record the license plate information by speaking to the controller. The keyboard, display, and controller may be packaged together as a singular unit, or separately.

It is to be noted that variations may be made to the rules of the game. For example, the game can be played on a time limit regardless of how much data has been recorded and the winner is the person with the most points at time expiration. Another example is to forbid the replacement of any line, so that once a line entry in sections 12, 14, 18 and 20 has been made, it cannot be replaced with a more valuable entry. Also, the game may be played without the enhancement techniques. That is, information may be recorded straight from the license plate and scored strictly on the basis of the alphanumeric characters appearing thereon, without further enhancement, such as by spelling out abbreviations, etc. Also, if more than one license plate appears on a vehicle, such as is common on trucks, contestants may be allowed to either use all of the plates observed, or only one (and preferably the most valuable) of the plates.

Although the invention has been shown and described with exemplary embodiments thereof, it should be understood by those skilled in the art that the foregoing and various other changes, omissions and additions may be made therein and thereto without departing from the spirit and scope of the invention.

We claim:

1. A method of playing a game comprising the steps of:

a) observing a license plate on a vehicle;

b) recording information from the license plate on a medium;

c) attributing points to the recorded information by attributing one point for each alphabetic character recorded and attributing the numerical value of each number recorded;

d) repeating steps a) through c) until the end of the game; and e) adding all the attributed points at the end of the game.

2. A method of playing a game in accordance with claim 1, wherein step c) comprises maximizing the points attributable to the alphanumeric characters on the license plate, by deriving formal, informal and phonetically spelled words, names, persons, places, things, abbreviations, expressions or phrases from the alphanumeric characters.

3. A method of playing a game in accordance with claim 1, wherein step b) comprises recording the description of pictures or images observed on the plate.

4. A method of playing a game in accordance with claim 1, wherein step b) comprises recording the information on a medium having sections for numbers and alphabetic characters.

5. A method of playing a game in accordance with claim 4, wherein the medium further comprises a section for license plate origin.

6. A method of playing a game in accordance with claim 4, wherein the game ends when all of the sections are completed.

7. A method of playing a game in accordance with claim 1, wherein the game ends after a predetermined time limit.

8. A method of playing a game in accordance with claim 1, wherein step b) comprises recording the origin of plate.

9. A method of playing a game in accordance with claim 1, wherein each license plate may be only used once for information.

10. A method of playing a game in accordance with claim 1, wherein the game is comprised of a keyboard, a display and a controller.

11. A method of playing a game comprising the steps of:

a) observing data on vehicle license plates; and b) attributing points for the license plates based on the observed data by attributing points for the alphabetic characters and the numbers observed; and c) adding all the attributed points at the end of the game.

12. A method of playing a game in accordance with claim 11, wherein step b) comprises maximizing the points attributable to alphanumeric characters observed on the license plate by deriving formal, informal and phonetically spelled words, names, persons, places, things, abbreviations, expressions or phrases from the alphanumeric characters.

13. A method of playing a game in accordance with claim 11, wherein step b) comprises attributing points for the description of pictures or images observed on the plate.

14. A method of playing a game in accordance with claim 11, wherein step b) comprises recording the information on a medium having sections for numbers and alphabetic characters.

15. A method of playing a game in accordance with claim 14, wherein the medium further comprises a section for license plate origin.

16. A method of playing a game in accordance with claim 14, wherein the game ends when all of the sections are completed.

17. A method of playing a game in accordance with claim 11, wherein the game ends after a predetermined time limit.

18. A method of playing a game in accordance with claim 11, wherein each license plate may be only used once for information.

19. A method of playing a game in accordance with claim 11, wherein the game is comprised of a keyboard, a display and a controller.

* * * * *